US006040854A

United States Patent [19]

Esser et al.

[11] Patent Number: 6,040,854

[45] Date of Patent: Mar. 21, 2000

[54] ELECTRO-OPTICAL PROCESS FOR THE STATIC HARMONIZATION OF WEAPON SYSTEMS AND AIRCRAFT

[75] Inventors: Thomas Esser, Karlsruhe; Ulrich Schneidereit, Donauwoerth, both of Germany

[73] Assignee: Eurocopter Deutschland GmbH, Germany

[21] Appl. No.: 08/974,399

[22] Filed: Nov. 19, 1997

[30] Foreign Application Priority Data

Nov. 19, 1996 [DE] Germany ..... 196 47 756

[51] Int. Cl.[7] ..... H04N 7/18

[52] U.S. Cl. ..... 348/159; 348/113

[58] Field of Search ..... 348/61, 113, 115, 348/117, 144, 159, 143; 89/41.01, 41.09, 41.21; 704/300; H04N 7/18

[56] References Cited

U.S. PATENT DOCUMENTS

| | | | |
|---|---|---|---|
| 3,641,261 | 2/1972 | Chaplin et al. | 178/7.8 |
| 4,318,330 | 3/1982 | Hausenblas | 89/41 |
| 4,614,913 | 9/1986 | Honeycutt et al. | 330/4.3 |
| 4,794,430 | 12/1988 | Wittaker et al. | 356/252 |
| 5,191,713 | 3/1993 | Alger et al. | 33/366 |
| 5,911,767 | 6/1999 | Garibotto et al. | 701/28 |

FOREIGN PATENT DOCUMENTS

| | | |
|---|---|---|
| 0 628 780 A1 | of 1994 | European Pat. Off. . |
| 30 44 554 A1 | of 1982 | Germany . |

*Primary Examiner*—Howard Britton
*Assistant Examiner*—Nhon T Diep
*Attorney, Agent, or Firm*—Evenson, McKeown, Edwards & Lenahan, P.L.L.C.

[57] ABSTRACT

The invention provides an electro-optical process and apparatus for the static harmonization of aircraft having onboard systems which are to be measured with respect to one another and on the fuselage axis. Adapters are arranged at preset measuring points on the aircraft, each of which accommodates a video camera which generates an external environment as a reference. The actual arming axes of an onboard systems which are measured are displayed against the external environment, based on the system coordinates of the aircraft.

8 Claims, 4 Drawing Sheets

CAMERA AND PROJECTOR ARE BOTH INSTALLED "ON BOARD" AND ARE THEREFORE PART OF THE ON BOARD SYSTEM OF COORDINATES, AND ARE THEREFORE FIXEDLY DEFINED WITH RESPECT TO ONE ANOTHER

ELECTRO-OPTICAL PROCESS FOR THE STATIC HARMONIZATION OF WEAPON SYSTEMS AND AIRCRAFT

BACKGROUND AND SUMMARY OF THE INVENTION

This application claims the priority of German application no. 196 47 756.5, the disclosure of which is expressly incorporated by reference herein.

The invention relates to an electro-optical process and apparatus for the static harmonization or calibration of weapon systems and aircraft having onboard systems which are to be measured with respect to one another and on the fuselage axis.

Aircraft are frequently equipped with sensors and onboard computers. One such onboard system is the weapons platform which is equipped with onboard guns or missile launching systems and optionally with electronic combat systems. In order to ensure a precise functioning of the sensors and of the various mission devices, the different axes of these onboard systems must be measured and setup or calibrated with respect to one another. This operating step during the assembly on the ground is called "static harmonization".

German Patent Document DE 30 44 554 A1 discloses a procedure for testing the conformity of the lines of sight of optical instruments with the line of target (the actual pointing axis) of weapons, using a predetermined measuring field. The desired positions of the lines of sight and lines of target are determined relative to one another and their coordinates are fed into a memory.

European Patent Document EU 0 628 780 A1 discloses a sighting device for a helicopter which is composed of a combination of an observation instrument, which is laterally integrated on the aircraft, and an axial firing device, which is installed on the front side of the aircraft. These two components are connected with the onboard calculator.

All previously existing harmonization processes and corresponding devices of the state of the art either use external sensors or measuring references to adjust to a measured environment, or a measuring adjustment is made from a standardized environment.

It is an object of the present invention to provide a process of the above-mentioned type that uses a reference system generated by the aircraft itself, from which the different deviation axes can be measured at low operating expenditures and with a high precision.

This object is achieved by the electro-optical process and apparatus according to the invention, in which mechanical adapters are fixedly mounted at all points of the aircraft to be measured. Each adapter has a video camera, and displays, relative to an external harmonization environment (that is, a calibration image projected on a wall or screen) as a reference, the real core axis of the onboard system which is to be measured, based on system coordinates of the aircraft. This arrangement permits simultaneous harmonization of the axes. The external environment is generated by one or two projectors which are mounted in a known fixed orientation relative to the main references of the aircraft itself. The main reference point or points of an aircraft are a result of its construction. The designers normally choose mechanically strong structural elements for reference points. The reference points serve to measure the tolerances/deviations of the aircraft geometry relative thereto. For the harmonization process, they are used as reference points relative to the position of other points or stations which are to be harmonized.

Other objects, advantages and novel features of the present invention will become apparent from the following detailed description of the invention when considered in conjunction with the accompanying drawings.

DETAILED DESCRIPTION OF THE DRAWINGS

Figure 1:
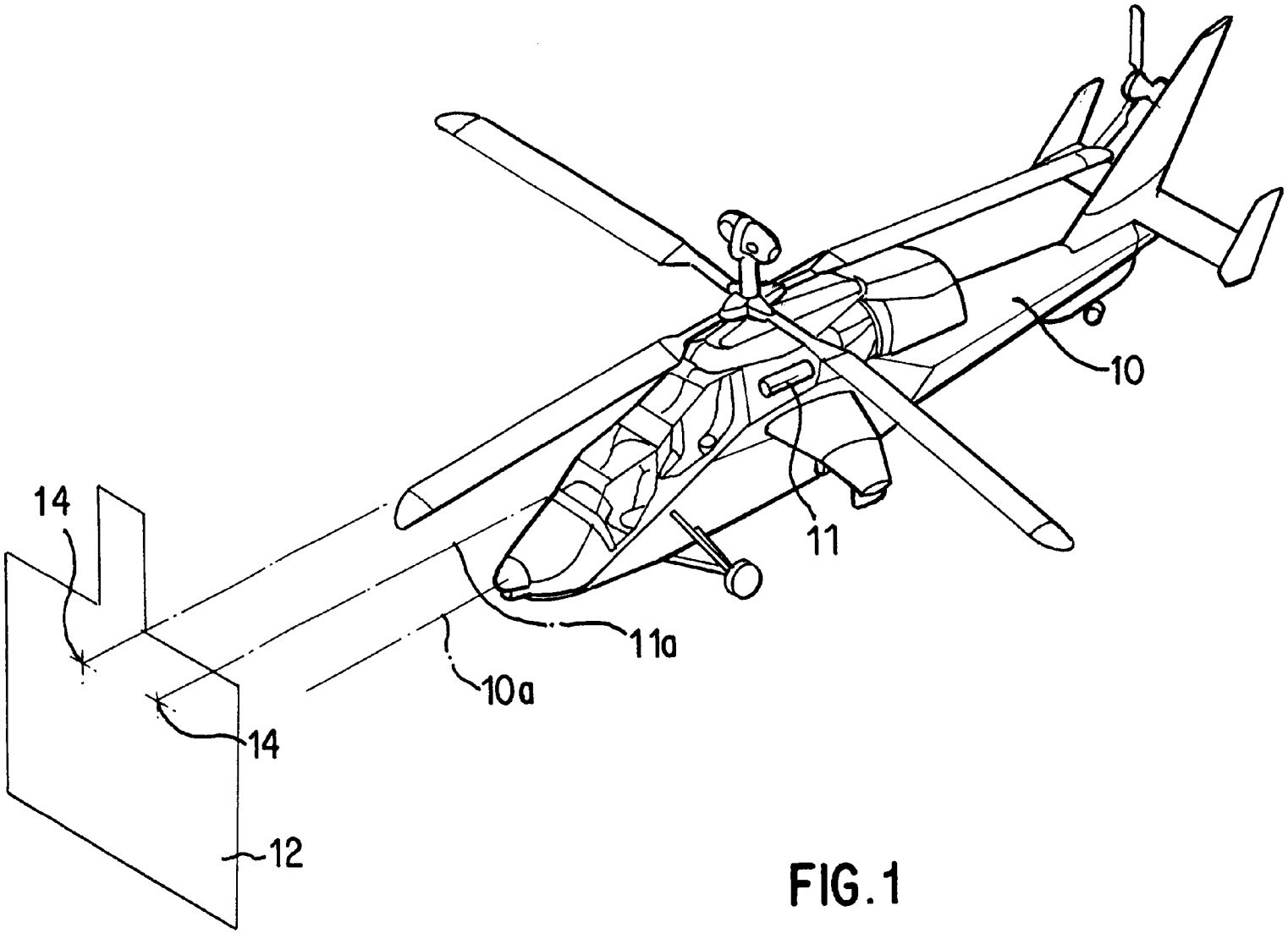
FIG. 1 is a perspective schematic view of an aircraft to be measured with a selected harmonization environment.

Every weapon system (in the present case, an aircraft, or helicopter) is manufactured with one or two main reference points which comprise one or two virtual axes of the system (that is, the aircraft) itself. Harmonization is the process by which each of the individual weapons stations included in the system is adjusted relative to the main reference points. This process, therefore, requires an offset measurement of each such weapon station.

The electro-optical process according to the invention uses a projector or projectors mounted at the main reference point of the weapon system (the aircraft). The image created by the projector or projectors comprises, at a defined distance towards a screen, or any wall, a one to one image of the aiming points of the weapons stations which are to be harmonized. The respective weapon stations of the weapon system are themselves equipped with video cameras which produce an image of the projected image, and therefore allow the readout of any deviation between the projected presentation of the ideal aiming point, and the target grid/cross-hair which is part of the PC overlay. The harmonization process may consist of either adjustment of the stations themselves, or the measurement of the offsets, depending on the design of the weapon system.

In the process according to the invention, the weapons system which has the image projectors mounted thereon is positioned toward a screen or a wall, which is situated at a defined distance. The projectors generate on the screen or wall a one to one representation of the points which are to be harmonized. Once the projectors are mounted at a known fixed orientation relative to the reference points of the aircraft, the location of the respective harmonization points is known relative to the aircraft also. The one to one representation is specific to each weapons system, and must be programmed into the weapon system PC which drives the projectors.

Each of the weapon stations or sensors is equipped with a video camera at its aircraft specific adaptor, mounted at the required points. The optical axes of the video cameras thus coincides with the stations on which they are mounted. Therefore, the respective video cameras are able to determine the actual aiming point of the weapon station with which they are associated, based on the projected image. Depending on the design of the weapon system, each station much either be adjusted, or as noted previously, its offset is determined and stored in the aircraft computer.

The general idea of the invention is based on the visual entry into the system of coordinates of the aircraft 10 to be measured. As used herein, the term "onboard system of coordinates" refers to the coordinates with respect to one main aircraft boresight axis, which in most types of aircraft is the main reference axis. By defining one main boresight axis (reference) and knowing the geometry of the aircraft, it is possible to determine the geometric position of each axis, simply from the design of the aircraft. The relationship among all axes of all weapon stations aboard the aircraft is therefore a result of the construction of each individual aircraft. However, that relationship is always fixed for a particular aircraft design.

Because, the projectors are installed at the main reference of the weapon system, the representation which they project towards a wall or screen is situated at a known location within the coordinate system of the aircraft itself. By means of one or several video cameras 11, the real axes of the core of the devices to be measured as well as their deviations (and therefore the harmonization deviation to be corrected) are displayed relative to an appropriately selected harmonization environment 12, such as a wall or screen, as noted previously. The operator therefore becomes capable of looking into the environmental reference (harmonization environment 12) directly from the respective point to the measured. For this purpose, the video cameras 11 are provided with a computer generated measuring-target grid, and the image acquired by the camera overlayed on the PC with a cross-hair. The projected representation can comprise a measuring grid having dimensions of mm-squares, or a paper based mm-grid can be fixed at the wall or screen and adjusted to the projected point's center. Knowing the distance between the camera and screen or wall, a deviation can be read directly on the PC by reading the cross-hair's position in relation to the center of the grid. Thus, the measuring target grid permits a direct determination of the deviation with respect to the externally selected reference point 14 at a defined distance.

Figure 2:
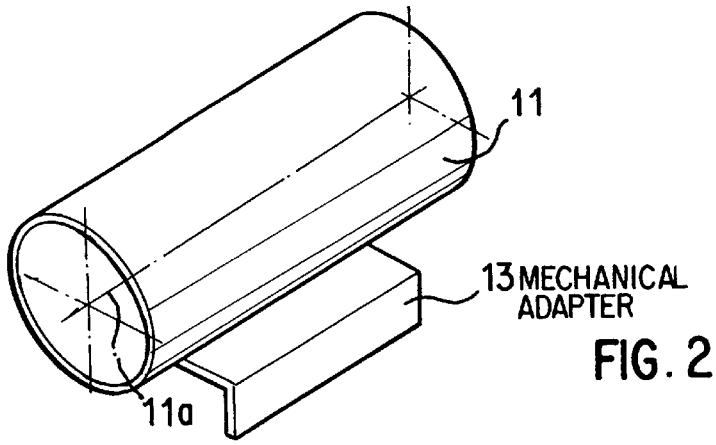
FIG. 2 is a perspective representation of several embodiments for a mechanical adapter for receiving and fixing the camera.
Figure 2A:
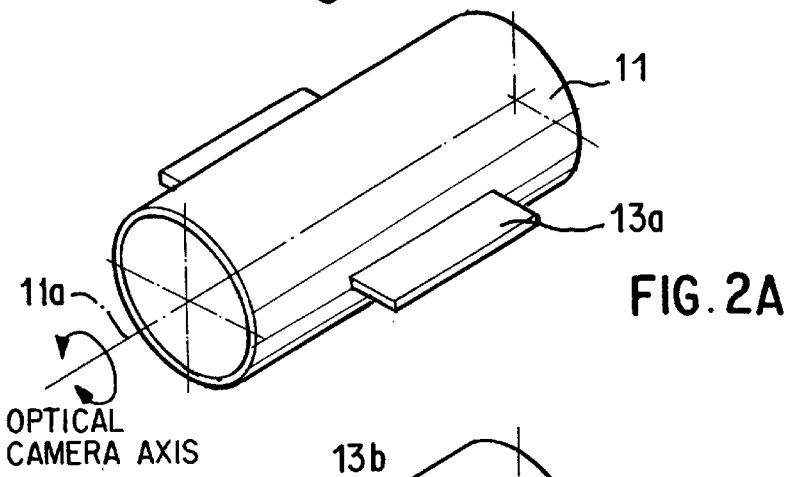
Figure 2B:
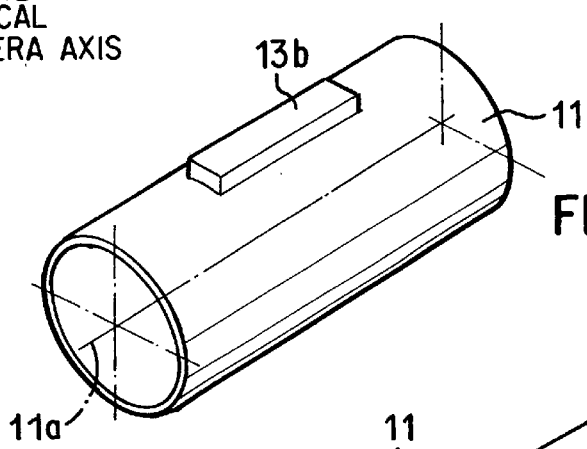
Figure 2C:
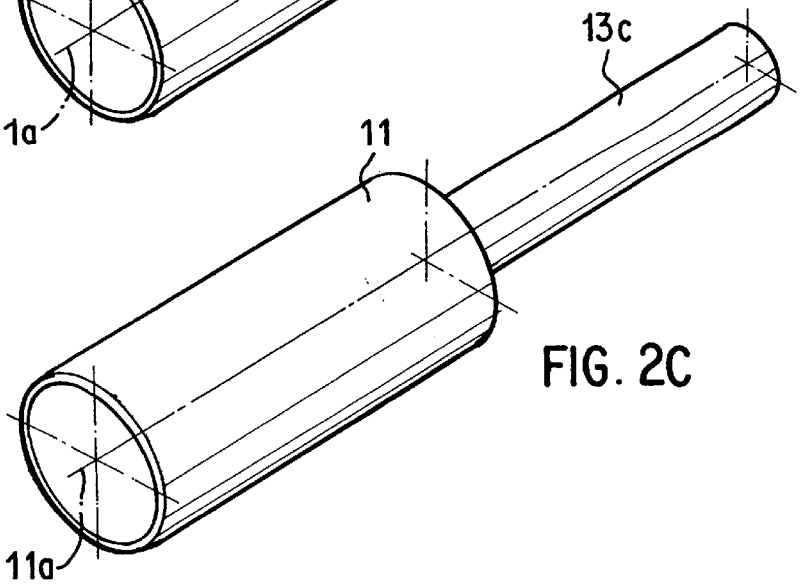

The video camera or cameras are provided with mechanical adapters which may have different designs or structures (FIG. 2), and permit access to all points of the aircraft 10 to be measured. The adapters are constructed so that the associated camera disposed therein is optionally rotatable or adjustable about its optical axis. Thus, an angle deviation measurement by means of a rotation generator is made possible.

In the simplest embodiment with only one video camera 11, the corresponding adapters 13, 13*a*, 13*b* . . . etc. are fixedly integrated in the aircraft on the respective axes to be measured, and the camera is simply slid into the respective adapter. In a more advanced embodiment, a camera is situated in each adapter so that a deviation measurement of all axes can take place simultaneously.

The adapters perform two functions: First, they provide a mechanical interface with the weapon station at the aircraft point which is to be measured; and second they act as a host to the video camera. The construction and design of the adapters must be precise in order to achieve good accuracy.

The adapters are depicted as having a cylindrical design by way of example only. Depending on the construction of the aircraft point/station which is to be measured, any design is feasible. The camera must always be within the adaptor, and the geometric relation between the adaptor mounting point relative to the aircraft, and camera optical center position must be taken into account. When the adapters are mounted at the measuring points, the camera inserted therein will provide an image comprising an optical direction of the measuring point/weapon station. By reading the difference at a defined distance to a wall or screen with respect to the projected desired center of the station that is being measured, it is possible to determine the deviation in mRad.

In a preferred embodiment of the invention the cameras are also capable of operating with infrared light in order to carry out measurements also under poor light conditions. The above-mentioned rotation generator permits a rotation deviation measurement as well as a readjustment. An optical system is therefore provided which, with relatively modest adaptation expenditures, can be brought to all points of the aircraft to be measured.

Thus, in a particularly efficient manner, the deviation of launchers for missiles and the axes of the cores of barrel weapons can be measured, and hard-to-access devices and instruments which require a harmonization, such as navigation sensors, are also easily and optimally measurable by means of the above-described measures. This is made possible because the camera takes the place of the system to be measured and looks to the "outside" upon a defined "reference", thus ensuring a direct reading of the position in the x-, y- and z-axis.

As mentioned above, when several video cameras are used, a deviation measurement of the required points (that is, of the respective weapon stations/sensors) is achieved within an extremely short time. Also, based on geometrical data of the aircraft, it is possible to externally generate a harmonization reference environment 12 simply by "looking at it", by means of video cameras integrated on the aircraft, and by marking the corresponding fixed points 14 of the environment, so that the other points to be measured can be parameterized. This is another advantage which the state of the art has not yet recognized.

Figure 3:
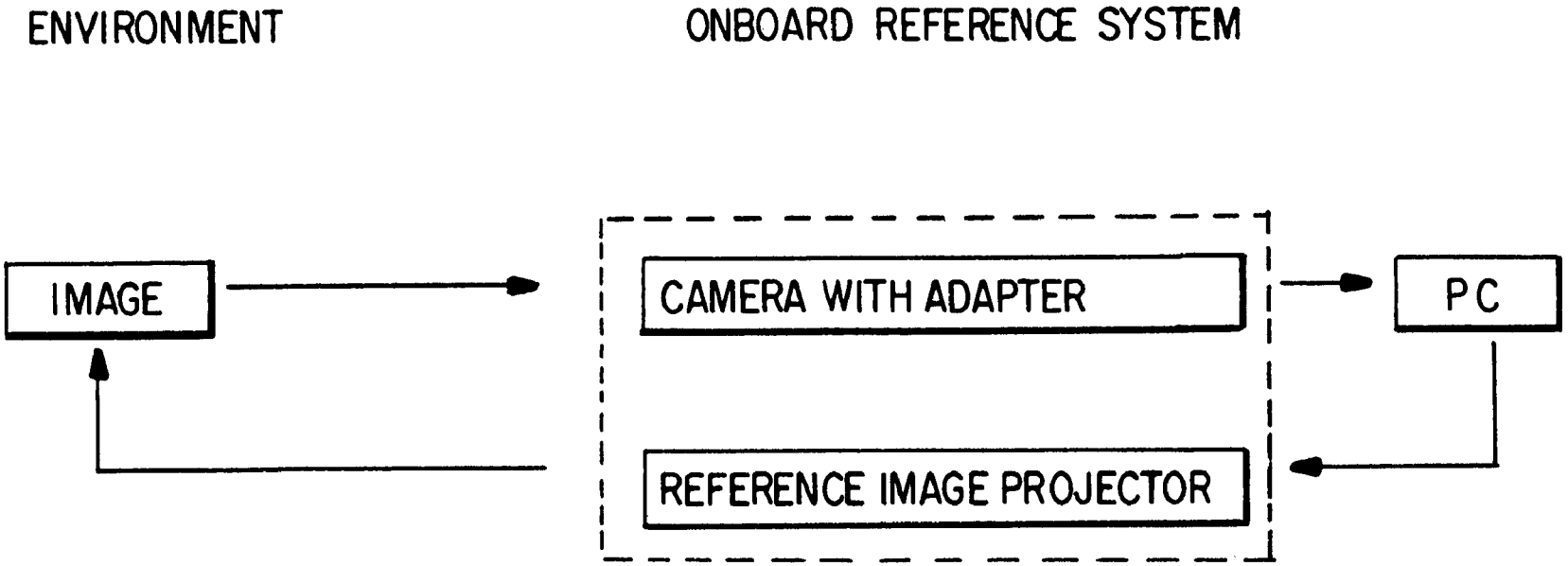
FIG. 3 illustrates the placement of the coordinates in the onboard system.
Figure 4:
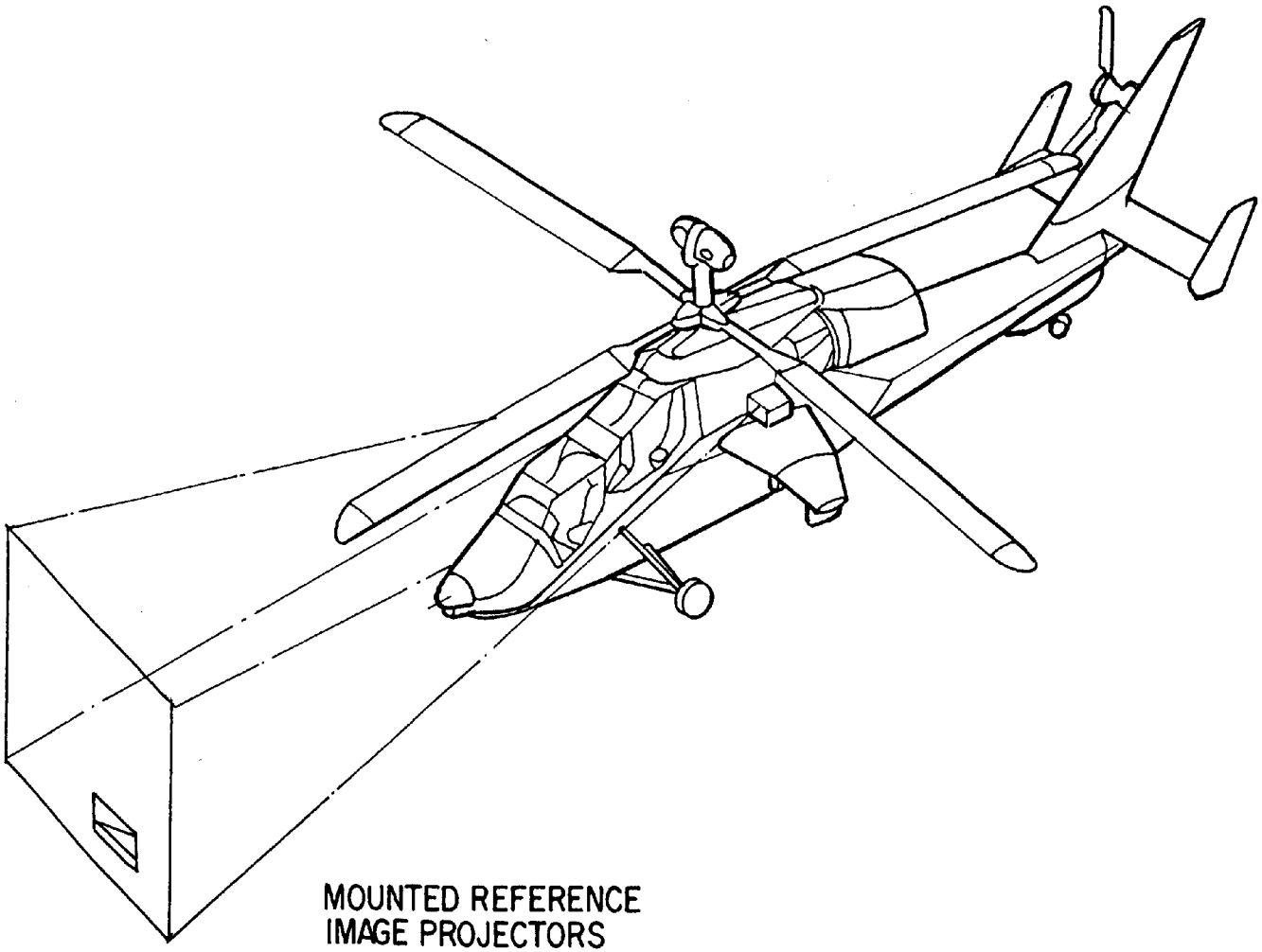
FIG. 4 illustrates the projection of a reference image from the onboard system of coordinates.

The second basic principle of the above-described process is that the image of the defined "reference" (target reference image) is generated based on the onboard system of coordinates, and therefore a measuring environment which is standardized with respect to the main reference is not necessary (FIG. 3). One or two projectors mounted at the main references ensure the generating of the target image and thus a measuring environment at every location. Thus, a standardization "in itself" is achieved. (See FIG. 4.)

Thus, by means of one or two projectors, such as laser TV, mounted at the main references, the external environmental reference 12 is generated. The thus generated "target reference image" permits a measurement which is independent of the environment, as well as a high-expenditure alignment of the aircraft or weapon system with respect to an external measuring environment. The generation of the reference measuring environment is therefore also transformed into the onboard system of coordinates.

Therefore, the weapon system—in this case, the aircraft—can virtually "carry along" its own sighting disk and thus its measuring environment. This is an extremely important operational advantage for a field-type measurement (FIG. 4), specifically because high-expenditure alignments and levelling are completely eliminated. However, the actual operating steps for the points to be measured are fully maintained.

Furthermore, the process may be implemented without cabling expenditures, by using network-independent video systems with an integrated video transmitter for the short range, and operating by means of monitors fed by one or several video signal receivers directly from the cockpit or from a single measuring point.

In another embodiment of the process, the video cameras are equipped for operation in the infrared range so that work can also be carried out under poor light conditions. Furthermore a quality control documentation can be established by storing the deviation images on video tapes, soft/hard disks, etc. By using a calibration bank to which every measuring camera can be brought with its pertaining attached adapter, a centering calibration of the ideal optical camera core axis can take place by tracking the target cross generated in a computer-assisted manner with respect to all mechanical and system-caused errors.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An electro-optical process for static harmonization of weapon systems and aircraft having onboard systems which are to be measured relative to one another and on the fuselage axis, by means of video cameras, said process comprising:

at all points of an aircraft to be measured, arranging mechanical adapters in which at least one video camera can be mounted to display, on an external harmonization environment as a reference, a reproduction of an actual core axis of the onboard systems to be measured from a system of coordinates of the aircraft and thus permits a simultaneous harmonization of axes; and generating an external environmental reference generated by means of one or two projectors mounted at the main references.

2. Process according to claim 1, wherein by means of several transmitting and receiving channels, a simultaneous measuring of the points of the aircraft which are to be measured can be carried out, without any remounting.

3. Device for carrying out the process according to claim 1, wherein the mechanical adapters are structured to receive the video cameras, are adapted to mechanical conditions existing at the receiving and fastening site, and are fixedly arranged at points of the aircraft to be measured.

4. Device according to claim 3, wherein short-range video transmitters are integrated in network-independent video cameras, and monitors are assigned to one or several video signal receivers, which monitors can be operated directly from the cockpit or from a single measuring point.

5. Device according to claim 3, wherein for defining a harmonization reference environment, at least two video cameras are arranged at main references of the aircraft to be measured.

6. Device according to claim 3, wherein video cameras with a computer generated measuring target grid are used.

7. Device according to claim 1, wherein laser TV is used as a projector.

8. Device according to claim 1, wherein by using a calibration bank on which each measuring camera with the pertaining attached adapter is mounted, a centering calibration of an ideal optical camera axis takes placed by tracking the target cross generated in a computer-assisted manner with respect to all mechanical and system-caused errors.

* * * * *